US005604424A

United States Patent [19]

Shuttleworth

[11] Patent Number: 5,604,424

[45] Date of Patent: Feb. 18, 1997

[54] ELECTRICAL CHANGEOVER SWITCHING

[75] Inventor: Roger Shuttleworth, Stockport, England

[73] Assignee: The National Grid Company PLC, Coventry, England

[21] Appl. No.: 238,210

[22] Filed: May 4, 1994

[30] Foreign Application Priority Data

Sep. 21, 1993 [GB] England ..... 9319470

[51] Int. Cl.[6] ..... G05F 1/20

[52] U.S. Cl. ..... 323/258

[58] Field of Search ..... 323/255, 257, 323/258, 346, 363, 343

[56] References Cited

U.S. PATENT DOCUMENTS

| | | | |
|---|---|---|---|
| 1,893,760 | 1/1933 | Boyajian | 323/258 |
| 1,914,193 | 6/1933 | Bedford | 323/258 |
| 1,947,292 | 2/1934 | Garman | 323/258 |
| 3,515,980 | 6/1970 | Throop | 323/343 |
| 3,662,253 | 5/1972 | Yamamoto | 323/343 |
| 3,743,921 | 7/1973 | Legg et al. | 323/258 |
| 4,622,513 | 11/1986 | Stich | 323/343 |

FOREIGN PATENT DOCUMENTS

| | | |
|---|---|---|
| 1638906 | 8/1970 | Germany . |
| 2125471 | 12/1972 | Germany . |
| 977248 | 12/1964 | United Kingdom . |
| 986913 | 3/1965 | United Kingdom . |

OTHER PUBLICATIONS

"Thyristor–Controlled Regulating Transformer For Variable Voltage Boosting" Proc. IEE, vol. 123, No. 10, Oct./1976 (pp. 1005–1009).

"Thyristor–Controlled Quadrature Boosting" (Arrillaga, et al) Proc. IEE, vol. 126, No. 6, Jun./1979 (pp. 493–498).

"A Static Alternative To The Transformer On–Load Tap–Changer" (Arrillaga, et al) Proc. IEE, vol. PAS–99, No. 1, Jan./Feb./1980 (pp. 86–91).

"A Thyristor Assisted Mechanical On–Load Tap Changer" (Roberts, et al) (pp. 185–192).

"The Thyristor–Controlled Static Phase Shifter—A New Tool For Power Flow Control In AC Transmission Systems" (Stemmler, et al) Brown Boveri Rev. 3–82 (pp. 73–78).

"Transformer Tap–Changer Using Thyristor Switching" (Fazli, et al) UPEC 1988 (3 pages).

"A 3–Phase Solid–State Transformer Tap–Changer" (Fazli, et al) UPEC 1990 (pp. 373–376).

"The Further Development of a Single–Phase Solid–State Tap–Changer" (Fazli et al.) UPEC 1990 (pp. 509–512).

"Electronic Tap Changers For Railway Power Supplies" (Faester, et al) ABB Review Apr./1990 (4 pages).

"Thyristor Assisted On–Load Tap Changer For Transformers" (Cooke, et al) University of Salford (5 pages).

"A Thyristor–Controlled Static Phase–Shifter For AC Power Transmission" (Mathur, et al) Trans. IEEE 1980 (6 pages).

"Thyristor–Controlled In–Phase Boosting For H.V. D.C. Convertors" (Arrillaga, et al) Proc. IEE, vol. 127 Pt. C., No. 4, Jul./1980 (pp. 221–227).

"Transient Stability Improvement Using Thyristor Controlled Quadrature Voltage Injection" (Arnold et al) IEEE Trans. vol. PAS–100, No. 3, Mar./1991 (pp. 1382–1388).

*Primary Examiner*—Peter S. Wong
*Assistant Examiner*—Adolf Berhane
*Attorney, Agent, or Firm*—McAulay Fisher Nissen Goldberg & Kiel, LLP

[57] ABSTRACT

A changeover switch for a tap changer including a pair of load switches. A diverter switch allows load to be diverted along a second path when its associated main switch is opened or closed. An auxiliary circuit has an auxiliary switch and a varistor connected in parallel across the secondary of a transformer. When the auxiliary switch is opened the varistor impedance is reflected onto the primary of the transformer which causes the current in the main switch to divert through the diverter switch so that the main switch can be opened or closed with substantially no load on it.

13 Claims, 6 Drawing Sheets

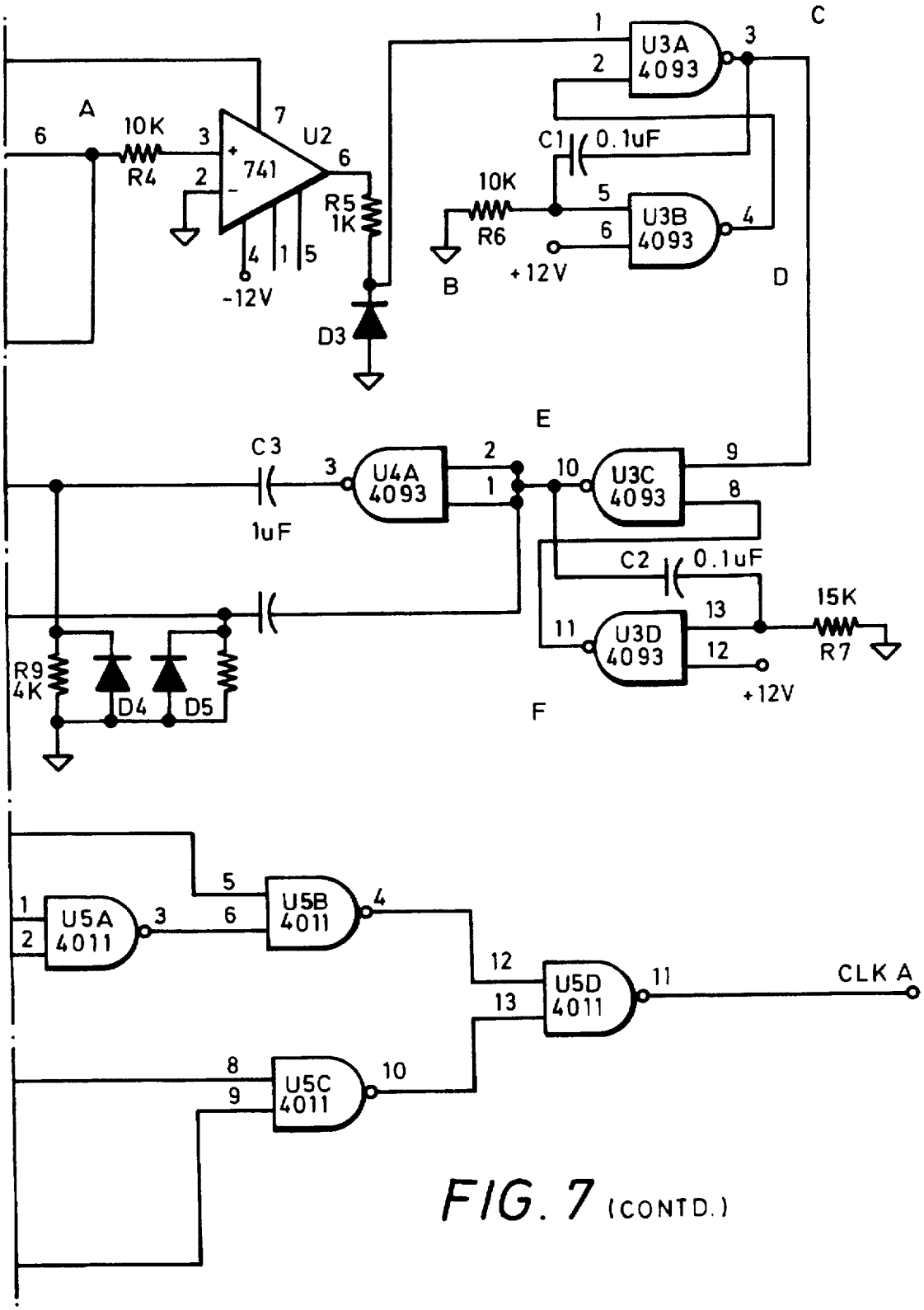
FIG. 7 (CONTD.)

ELECTRICAL CHANGEOVER SWITCHING

FIELD OF THE INVENTION

This invention relates to electrical changeover switches. The invention is particularly applicable to switching heavy electrical loads, for example tap changers used in the regulation of the output of power transformers in, for example, electricity transmission and distribution networks.

BACKGROUND OF THE INVENTION

At present, star/delta connected power transformers used for three-phase electricity distribution networks have rated voltage levels in the range of 30 to 420 kV and rated currents up to 5000 A. Usually the voltage levels of the tap changers are ±5–10% of total rated transformer voltage, i.e. 22 kV or more, and the current ratings range from 300 to 3000 A.

Tap changing is the main method of providing regulation and control of the output voltage from each phase of a power transformer in an electrical distribution system. By connecting and disconnecting groups of winding turns, the power transformer voltage can be controlled despite a varying incoming voltage. The tap changer comprises a pair of contacts for connecting a point on the power transformer output winding into the circuit. The contacts are mechanically driven in an insulating oil bath.

Conventional tap changers can be divided into two categories, i.e. off-circuit tap changers and on-load tap changers. Off-circuit tap changers are those by which changes are made when the load current is off, while on-load tap changers are those in which the changes are carried out without interrupting load current. In order to control large high-voltage distribution networks and to maintain correct system voltages on industrial and domestic supplies, it is now common practice to use on-load tap changers. These have two main features: they have impedance in the form of either resistance or reactance to limit the current circulating between two taps; and a duplicate circuit is provided so that the load current can be carried by one circuit while switching is being effected in the other.

FIG. 1 shows an early form of reactor tap changer. There is only a single winding on the transformer. A current breaking switch is connected to each tap. Alternate switches are connected together to form two separate groups which are connected to the outer terminals of a separate mid-point reactor. The operating principle can be described as follows. At a first position, switch 1 is closed and the circuit is completed through half the reactor winding. To change taps by one position, switch 2 is closed in addition to switch 1. The reactor then bridges a winding section between two taps and gives a mid-voltage. To complete the tap change switch 1 is opened so that the circuit includes the second tap on the transformer winding. Tap changes can thus be effected by stepping tap by tap along the winding, executing the switch closing sequence each time.

Because a relatively large number of high current breaking switches are needed and consequently large dimensions and oil quantities are involved, this simple design was replaced by a new form in which two off-load tapping selectors and two current breaking or diverter switches were used. The selector and diverter switches are interlocked by mechanical gearing so that when either of the two tap selectors is to be moved, the corresponding diverter switch is open while the other switch is closed. After the process of the off-load tap selecting is finished, the state of the two diverter switches are changed, i.e. from on to off and from off to on.

There are also resistor-type tap changer arrangements in use. FIG. 2 shows a typical example comprising a tap selector and a diverter switch both of which are immersed in transformer oil. The tap selector selects the tappings, its electrical contacts being designed to carry but not to make or break load current. However, the diverter switch is designed to carry, make and break the load current. The transition resistors in the diverter circuit are used to perform two functions. Firstly, they bridge the tap in use and the tap to be used next for the purpose of transferring load current during tap changing. Secondly, they limit the circulating current due to the voltage difference between the two taps. As the arcuate contact moves in the direction of the arrow the load is first shared by the connected tap selectors on opposite sides and then transferred from one to the other when the contact comes to rest on the opposite terminals shown in the drawing.

The resistor-type tap changer is now used extensively by British and European electricity utility companies. This is because, relative to the reactor-type of tap changer, the modern resistor type of tap changer has a relatively high speed (due to the incorporation of energy storage springs in the driving mechanism); the intertap circulating current is of unity power factor; arcing time is short; contact life is extended (typically ten times longer) relative to the reactor-type; and maintenance requirements are reduced due to a lower rate of contamination of the transformer oil.

Although resistor-type tap changers have many advantages over the reactor type they are still mechanical. A main disadvantage is that the resistors cannot be continuously rated if their physical size is to be kept manageably small. Tap changing is still accompanied by arcing at the contacts, and transformer oil is still contaminated and should be replaced regularly. The arrangement of contacts makes the working life shorter and reliability lower. The mechanical drives have complicated gearing and shafting, the failure of which could be disastrous. Tap changers have a reputation for sticking contacts. While the speed of the diverter switch is in the range 50 to 100 ms, the selector switch is much slower with a speed of change time in the order of minutes.

There are several different schemes for solid state switch assisted on-load tap changers. The main intention of these schemes is to suppress the arc by incorporating thyristors in the diverter switches. For example, it has been proposed to superimpose thyristors across the arcing contacts of the diverter switches of the arrangement in FIG. 2. The arcing across the contacts is minimised because the making and breaking contacts will be shorted by the corresponding thyristors. Thus, while they complement existing on-load resistor-type tap changers, the tap changer itself is still mechanical in nature. The response speed is slow.

Thyristors usable in tap changers would be required to survive faults that may occur in the power system external to the transformer. For a large transformer having, say, a 240 MVA rating, the tap changer must be capable of passing 10 KA for a period of three seconds with a D.C. component superposed. The initial peak value of current in this case is about 25 kA, superposed. Normally the surge current rating given for a thyristor is for a 10 ms period only. The thyristor's surge current capability decreases with the increase of surge period. For a fault duration of three seconds, continuous current ratings would be applicable. Therefore, the full current level is the governing factor in determining the maximum permissible steady state current rating of the thyristors to be used in an electronic tap changer. Thus, at the present current rating level of commercially available thyristors (approximately 4000 A rms), devices must be connected in parallel to spread the load. Secondly, as a consequence the circuit design is complicated by the need to ensure parallel thyristors share current equally. Furthermore, power losses and therefore operating costs are high. Thus, thyristors are impracticable as power switches.

SUMMARY OF THE INVENTION

It is a first object of the present invention to provide a changeover switch for heavy electrical loads which minimises the use of mechanical switches as far as possible.

It is a further object of the invention to provide a changeover switch for heavy electrical loads which has a fast response time.

It is also an object of the present invention to produce a changeover switch for heavy electrical loads at reasonable cost with high reliability.

It is also an object of the present invention to provide a changeover switch in which the power losses should be as low as possible.

According to the present invention there is provided a changeover switch for heavy electrical loads, comprising a pair of first main switches capable of bearing the said loads along respective first electrical paths, a pair of diverter switches, each for diverting current in the respective first paths along a respective second path during changeover, and an auxiliary circuit comprising a transformer, having a primary winding connected in a common portion of the first paths, an auxiliary switch and an impedance both connected across the secondary winding of the transformer.

Each diverter switch allows the load to be diverted along the second path when the main switch is opened or closed. The auxiliary switch shorts the impedance across the secondary of the transformer in the normal operating condition. When the auxiliary switch is opened the impedance is reflected onto the primary of the transformer. This reflected impedance causes the current in the main switch to divert onto the, now closed, diverter switch so that the main switch can be opened or closed with substantially no load on it. The problem of ensuring smooth transfer of current from the main switch to the diverter switch is overcome by means of the auxiliary circuit.

The present invention can be used to provide a fast response hybrid tap changer which uses solid state diverter switching and mechanical contact main switches. The solid state switching used in the diverter element switches at or near current zeros.

Preferably, the second paths each include a low value snubbing inductance to one end of which the diverter switches are commonly connected. Alternatively, the leakage inductance of the transfoiler itself may suffice. The other end of the inductance may be connected to one end of the primary winding of the transformer, the other end of the primary winding being commonly connected between the main switches. Preferably, the main switches are vacuum circuit breakers. These are high reliability devices.

Preferably, each diverter switch and/or the auxiliary switch is a thyristor-based switch though other types of semi-conductor switches can be used. The diverter switch may be a diode bridge rectifier circuit in which the rectified output is connected to power switching means, such as a gate turn-off thyristor.

The impedance in the auxiliary circuit is desirably a varistor or other means for producing a constant voltage across the primary winding.

The invention also extends to a method of changeover switching a heavy electrical load using a changeover switch as defined above, the method comprising:

actuating one of the pair of diverter switches associated with the one of the main switches that is closed;

opening the auxiliary switch so that current in the first path is diverted along the second path associated with the said one diverter switch;

opening the said one closed main switch;

closing the other diverter switch;

closing the auxiliary switch so that current is diverted to the second path associated with the said other diverter switch;

closing the other main switch; and opening the said other diverter switch so that current is diverted to the first path associated with the said other main switch.

Preferably, the opening and closing of the diverter switches and the main switches is synchronised to load current zeros.

The invention also extends to a tap changer comprising a high voltage transformer winding, a switch as defined above and a plurality of tap breakers connected between taps in the winding and either of the first paths.

DETAILED DESCRIPTION OF THE PREFERRED EMBODIMENTS

Figure 1:
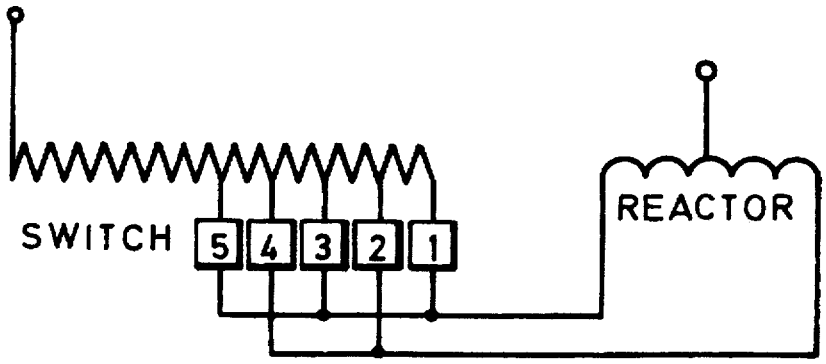
FIG. 1 PRIOR ART
FIG. 1 is an early form of reactor tap changer.
Figure 2:
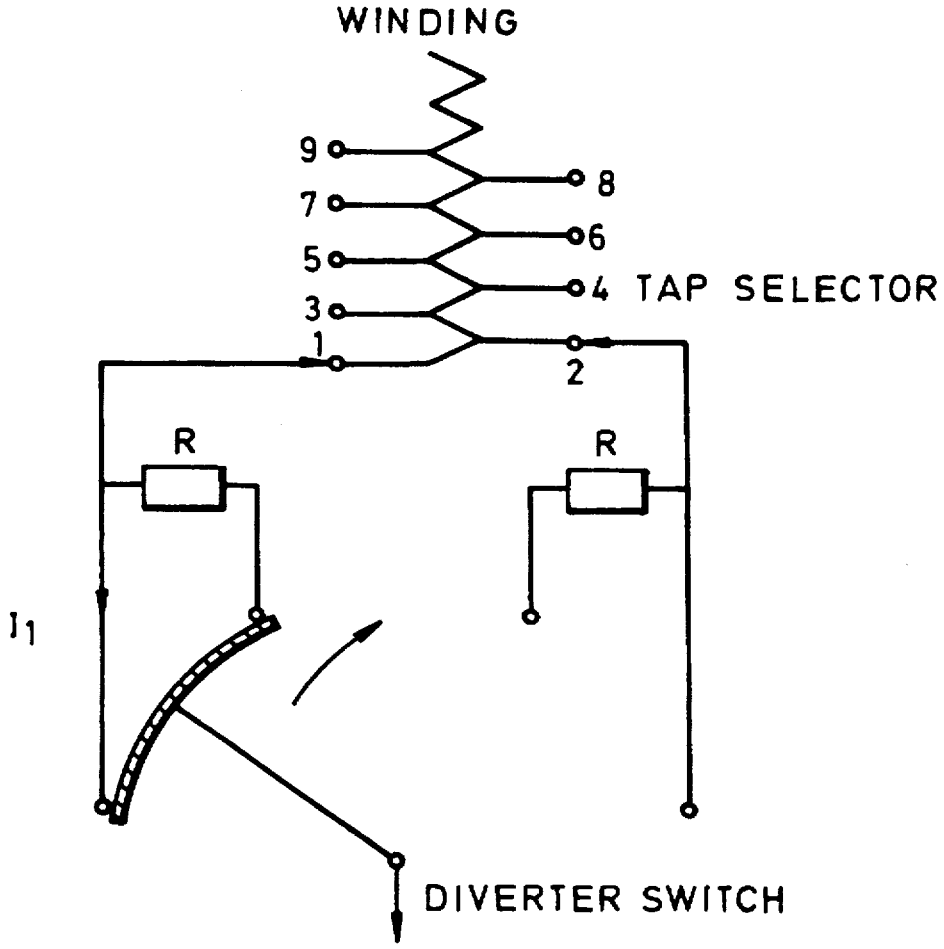
FIG. 2 PRIOR ART
FIG. 2 is an example of a resistor-type changer in use.
Figure 3:
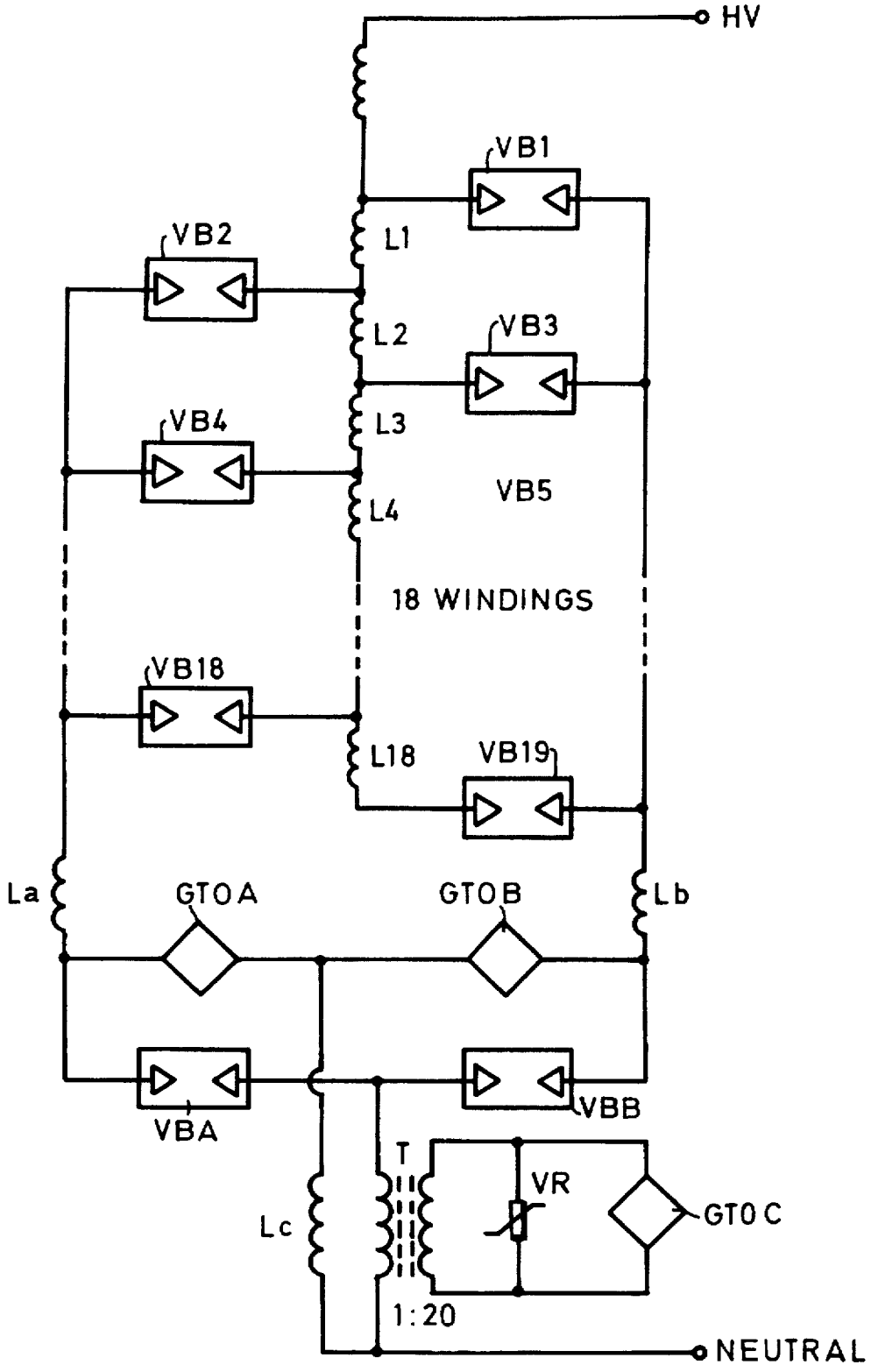
FIG. 3 is an illustration of a tap changer according to the invention.

Referring to FIG. 3 of the drawings, a tap changer for a high voltage distribution or transmission transformer typically comprises a series of 19 tap vacuum circuit breakers VB1–19 between the high voltage and neutral terminals of an electricity a.c. supply. The skilled person will be aware of the vacuum breakers commonly used in power transformers. For example, they are described in the Article 'Load Tap Changing with Vacuum Interrupters', in IEEE Transactions on Power Apparatus and Systems, Vol. PAS-86, N04, April 1967. In this particular example the vacuum breakers used are type V504E manufactured by Vacuum Interrupters Limited of London N3, England.

The vacuum breaker has contacts sealed in an evacuated enclosure. During contact separation, a plasma created by the vaporisation of the contact material provides a way for the continuation of current flow. The charge carriers making up the plasma disperse very rapidly in the high vacuum and recombine on the metal surfaces of the contacts. The metal ions leaving the vacuum arc in this way are continuously replaced by new charge carriers generated by the vaporising contact material at its root. At current zero the generation of the charge carriers stops, but their recombination continues. Therefore the contact zone is rapidly deionised and the current is broken.

Vacuum circuit breakers are also reliable particularly when they are constructed so that the only moving part is a single movable contact. This also has a relatively long service life and low maintenance requirements relative to switches immersed in transformer oil. The fire risk is also improved using vacuum circuit breakers.

Each tap breaker VB1–19 is connected, at one terminal, to a point in the high voltage transformer winding which divides the winding into a set of eighteen constituent winding parts L1–18. Similarly, not all the taps and winding parts are specifically illustrated. The other terminals of every other tap breaker VB1, 3, 5–19 and VB2, 4–18 are respectively commonly connected to inductors La and Lb. While the inductors La and Lb are indicated as discrete components, there is sufficient leakage inductance inherent in the tap windings in many circumstances. The opposite ends of the inductors are connected through two serially connected main vacuum circuit breakers VBA and VBB similar to those used for the tap breakers VB1–19. Two serially connected gate turn-off thyristor (GTO) switches GTOA and GTOB are connected in parallel across the main breakers VBA and VBB between the opposite ends of the inductors La and Lb.

An inductor Lc is connected between the GTO switches GTOA and GTOB and to the neutral terminal of the transformer winding.

An auxiliary circuit is associated with the changeover breakers VBA and VBB. The primary winding of, in this example, a 1:20 ratio auxiliary transformer T is connected between the changeover breakers and the neutral terminal of the high voltage transformer. A varistor VR or other constant voltage device, is connected across the secondary winding and an auxiliary GTO thyristor switch GTOC is connected in parallel with the varistor VR across the auxiliary transformer T.

Figure 4:
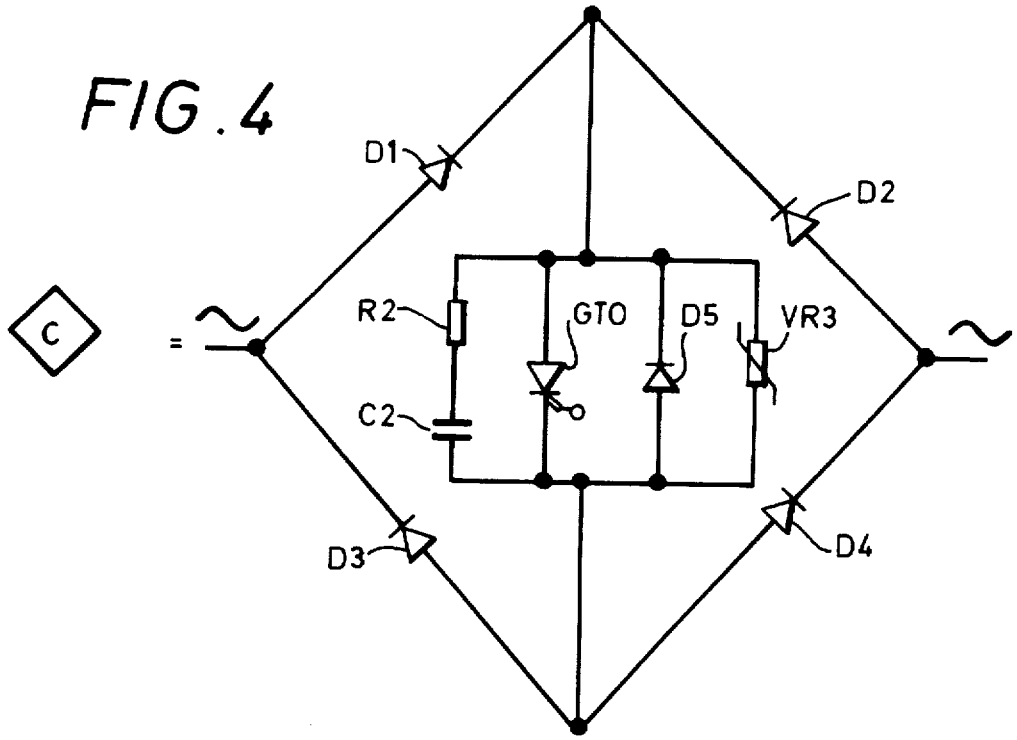
FIG. 4 is a circuit diagram of a gate turn-off thyristor circuit for use in the tap changer of FIG. 3.
Figure 5:
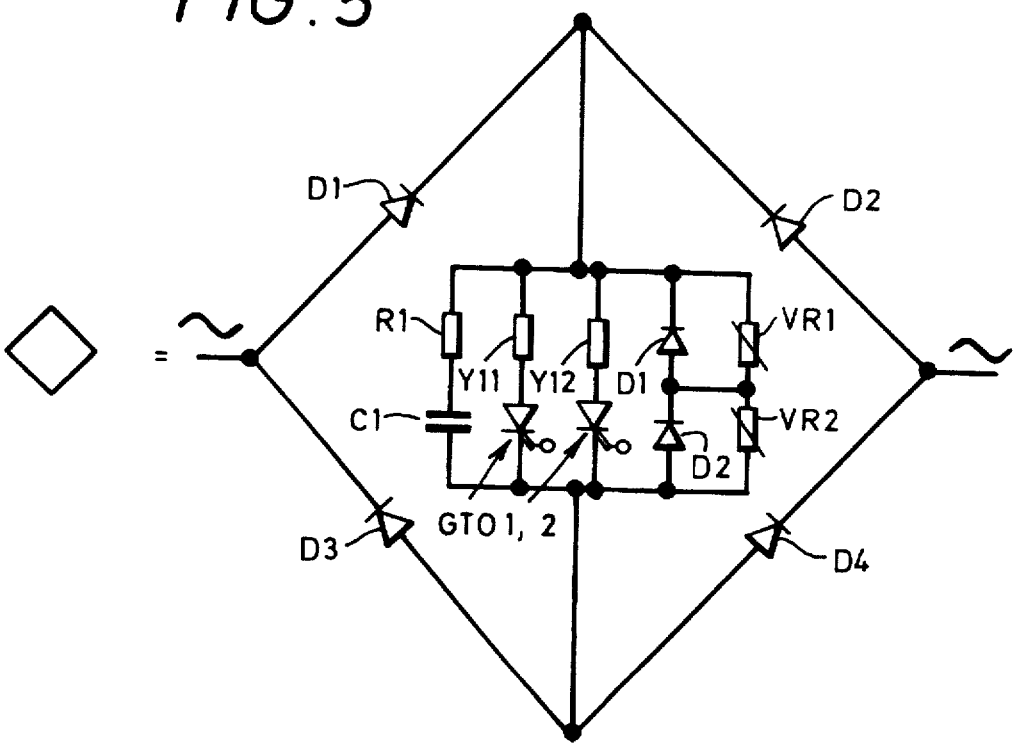
FIG. 5 is a circuit diagram of a double gate turn-off thyristor circuit for use in a modified form of the tap changer of FIG. 3.

In this particular example, the GTO thyristors GTOA and GTOB used are sold under device reference DG 758BX45 by GEC Plessey Semiconductors. More detail of the GTO thyristor switches are shown in FIG. 4. Each switch comprises an anti-parallel diode bridge arrangement although other rectifying circuits can be used. The diodes used are sold under reference DFB55 by GEC Plessey Semiconductors. The GTO thyristor is connected in circuit between respective pairs of diodes D1/D2 and D3/D4 arranged in the anti-parallel bridge configuration. The GTO thyristor is centrally connected between oppositely conducting diodes in conventional manner. The GTO thyristor is actuated by opto-isolated (or magnetically isolated) signals driving a floating power supply and gate drive. The thyristor is force commutated. This is illustrated in FIG. 5 which shows in more detail the GTO-based switch for GTOA and GTOB. The same principle of construction applies equally to GTOC.

The GTO thyristors GTOA, GTOB and GTOC are each supplemented by a turn-off snubber circuit which comprises a resistor/capacitor pair R2/C2 in series connected across the GTO and a varistor VR3 connected across the resistor/capacitor pair. A diode D5 is connected across the GTO. When the GTO is turned off, by removing the actuating signal from its gate, load current diverts onto the snubber capacitor C2 through the resistor R2. This limits the rate of rise of voltage across the GTO.

Although in a multi-phased power distribution system the power factor is kept close to unity and steady state, under some conditions the phase difference between current and voltage can be anywhere between ±180°. Thus, a fast response tap changer must be capable of working over the full range of power factors. Thyristors would have difficulty in commutating. Although it is possible to devise circuitry in which ordinary thyristors could be used. GTO thyristors are more suited for this application because standard thyristors create a temporary tap-to-tap short circuit when going, for example, from a high voltage to a lower voltage tap at leading power factors. GTO thyristors are turned off from the gate terminal and do not suffer from this.

The present invention circumvents the need to take into account power factor considerations by using the auxiliary circuit to transfer smoothly load current from the vacuum circuit breaker to the parallel diverter GTO switches. Referring again to FIG. 3, in steady state the switch GTOC is closed. Consequently, the transformer secondary winding is short-circuited. When full load current (typically 1 KA) flows through the primary of the transformer T, due to the turns ratio of 1:20, 50 A rms flows through the switch GTOC. This is within the capacity of the large GTO thyristors available.

Assuming the main breaker VBA is initially closed and the circuit through the high voltage transformer follows its path through, for example, the tap breaker VB2 which is also closed, to begin a tap change the auxiliary switch GTOC in the auxiliary diverter switch circuit is turned off, just after the main breaker GTOA, is turned on. The current in the auxiliary transformer secondary winding now flows through the varistor VR, creating a secondary square-wave voltage of 1 kV and a primary square-wave voltage of 50 volts. The primary square-wave voltage is sufficient to divert the load current from the main breaker VBA to its associated diverter switch GTOA. The rate of transfer of current from the main breaker VBA to the diverter switch GTOA is governed by the primary square-wave voltage of 50 volts and the size of the inductor Lc. The rate of rise of current in the switch GTOA must be limited in its capacity.

Having transferred the load current to the switch GTOA, the vacuum switch VBA can be opened without a substantial current and therefore little arcing. To complete the tap change to, for example, L1+L2 ( which is a tap change down) the tap isolator VB3 will have to be closed in preparation and the tap isolator VB2 opened. At a current zero the diverter switch GTOA is turned off and the diverter switch GTOB, associated with the main breaker VBB, is turned on. Thereafter the load current, now following the diverted path through the diverter switch GTOB, can be transferred to the main path by closing the main breaker VBB and then the auxiliary switch GTOC to remove the reflected impedance from the primary of the auxiliary transformer by shorting across the varistor VR.

The two main breakers VBA and VBB, due to the presence of the auxiliary circuit, never have to make or break a heavy current. The only current will be the leakage current of the auxiliary switch GTOC referred to the primary of the auxiliary transformer T and the magnetising current of the transformer T. This is likely to be in the region of about 3 A and will result in neglible contact wear.

For design reliability it is considered necessary to operate GTOs at about 70% to 80% of the recommended rated voltage. In many higher voltage applications, such as the electricity distribution networks, the currently available GTOs may be inadequate to achieve this. For example, the DG758BX45 GTO previously mentioned has a voltage rating of 4500 V and a current rating of 1365 A for halfwave rectification. Thus, it may be necessary to use two GTO's in parallel for the diverter circuits associated with the main breakers VBA and VBB. A double GTO anti-parallel bridge arrangement in place of the circuits GTOA and GTOB is illustrated in FIG. 5. Again, suitable snubber circuitry is connected around two GTO thyristors connected between the anti-parallel diodes.

It has previously been necessary to effect a tap change in a sequence of steps between adjacent winding parts on alternate legs of the high voltage paths. The present invention allows larger steps to be taken between non-neighbouring taps. For example, a gate turn-off thyristor may have a breakdown voltage of about 4.5 KV or more. With a typical voltage drop across a tap of 1 KV it is possible to change 3 taps in one step.

Figure 7:
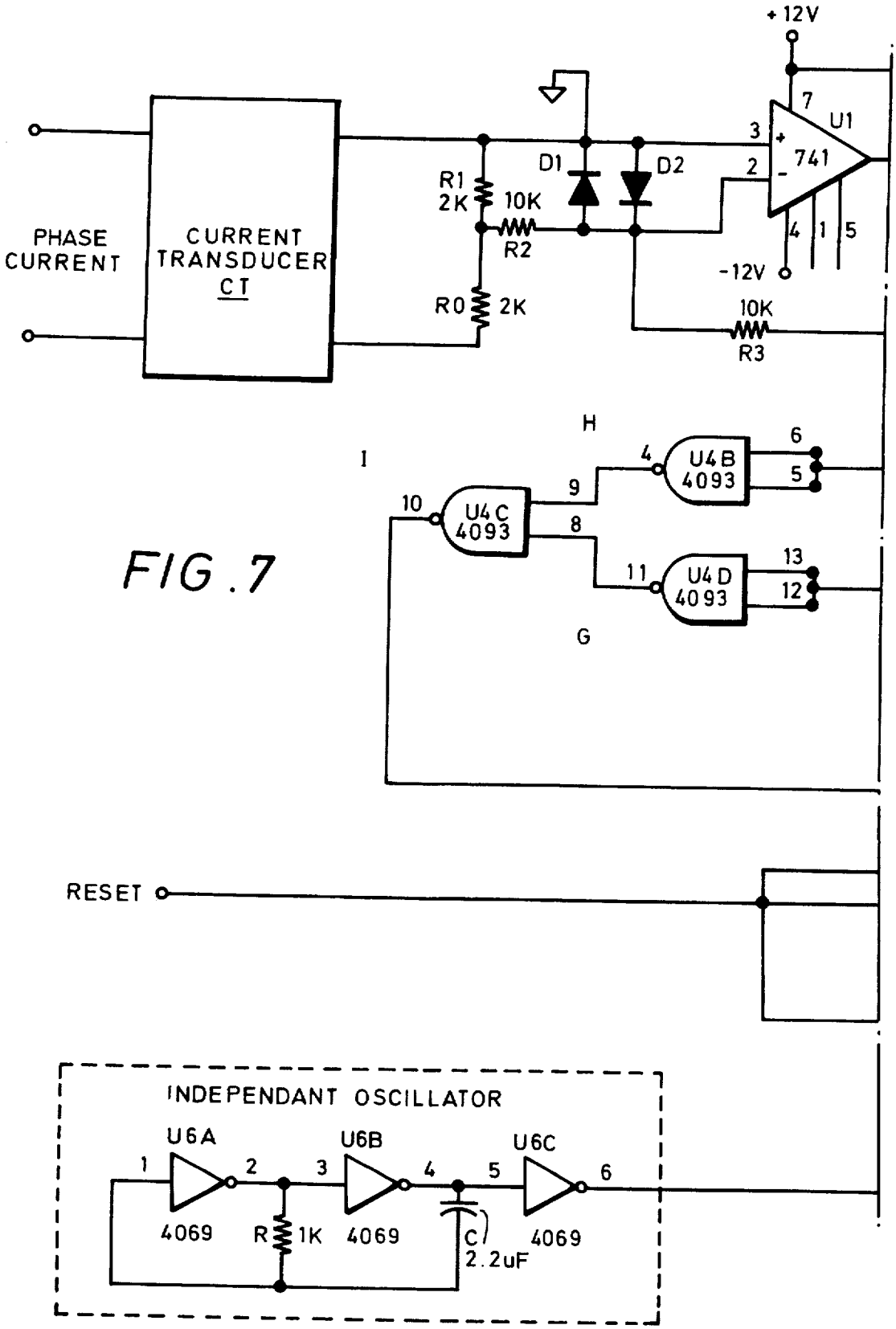
FIG. 7 is a circuit diagram of a clock for use with the invention.

It is necessary for the diverter switches GTOA and GTOB to switch at or near a current zero to ensure low switching losses. Therefore a circuit is needed to enable the GTO's to be correctly timed. A clock signal can be derived from the main a.c. current. For example, FIG. 7 illustrates a clock pulse generating circuit for one phase. It will be appreciated that a multi-phase supply will require separate synchronisation for each phase. A current transducer CT isolates the main a.c. circuit from the control logic and produces a signal proportional to main current. This signal is buffered by an inverting amplifier U1 and then applied to the input of a second operational amplifier U2 which is arranged as a comparator. A diode D3 clamps the output voltage of the comparator to ensure compatibility with following logic circuitry. A conventional arrangement of NAND gates and associated resistor and capacitor components produces pulses in synchronisation with the current zeros at the output CLKA.

Figure 6:
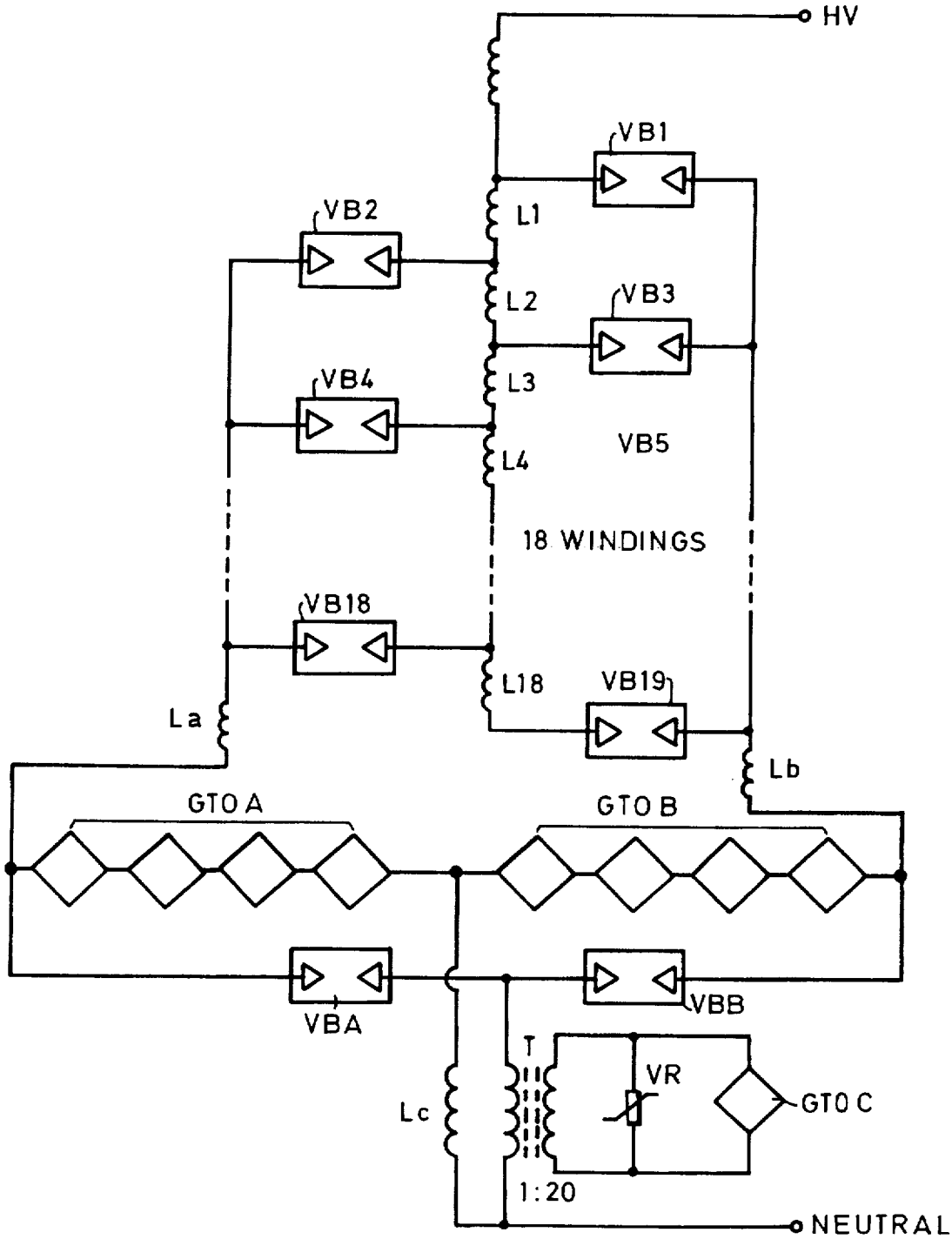
FIG. 6 is a modified version of the invention in FIG. 3.

FIG. 6 illustrates an alternative embodiment of the invention in which four gate turn-off thyristors A and B are connected in series in place of each of the switches GTOA and GTOB in FIG. 3. The GTO thyristors together can bear a greater voltage drop. Thus, increased steps across larger numbers of taps are possible. In this case, the full nine taps in each main path can be spanned in one tap change step.

The skilled person will appreciate that variation of the disclosed arrangements are possible without departing from the invention. For example, while a tap changer is disclosed the basic changeover switch has application in other fields in which a heavy current supply has to be transferred from one main path to another. The diverted paths may not have a commonly connected portion but still similarly utilise a snubber inductance Lc to the same effect. Equally, the same current paths may not have a common portion, but use separate synchronised auxiliary circuits in certain applications.

What is claimed is:

1. A changeover switch for heavy electrical loads comprising:

a pair of first main switches capable of bearing said electrical loads along respective first electrical paths which share a common portion;

a pair of diverter switches each for diverting current in said respective first paths along a second path during changeover; and an auxiliary circuit comprising a transformer, an auxiliary switch and an impedance, said transformer having primary and secondary windings;

the primary winding of said transformer being connected in said common portion of said first paths; and said auxiliary switch and said impedance both being connected across the secondary winding of said transformer.

2. The switch of claim 1 in which said second paths include a snubbing inductance to one end of which said diverter switches are commonly connected.

3. The switch of claim 2 in which the other end of said snubbing inductance is connected to one end of said primary winding of said transformer, the other end of said primary winding being commonly connected between said main switches.

4. The switch of claim 1 in which each said main switch is a vacuum circuit breaker.

5. The switch of claim 1 in which each said diverter switch and/or said auxiliary switch is a thyristor-based switch.

6. The switch of claim 1 in which each said diverter switch comprises a diode bridge rectifier circuit having power switching means connected with the rectified output of said bridge.

7. The switch of claim 6 in which said or each of said power switching means are a gate turn-off thyristor.

8. The switch of claim 1 in which said impedance in said auxiliary circuit is a varistor.

9. A tap changer comprising a high voltage transformer winding, a changeover switch as claimed in claim 1 and a plurality of tap breakers connected between taps in said winding and either of said first paths.

10. A method of changeover switching a heavy electrical load utilizing a changeover switch having a pair of main switches capable of bearing said load along respective first electrical paths which share a common portion, and a pair of diverter switches for diverting current in said respective first paths along respective second electrical paths associated with said diverter switches during changeover, said changeover switch further including an auxiliary circuit comprising a transformer, an auxiliary switch and an impedance, said transformer having primary and secondary windings, the primary winding of said transformer being connected in the common portions of said first paths, and said auxiliary switch and said impedance both being connected across the second winding of said transformer, said method comprising the steps of:

actuating one of said pair of diverter switches associated with one of said pair of main switches when said one main switch is closed;

opening said auxiliary switch so that current in the first path associated with said one main switch is diverted along the second path associated with said one diverter switch;

opening said one main switch;

closing said other one of said pair of diverter switches;

closing said auxiliary switch so that a current is diverted to the second path associated with said other diverter switch;

closing said other one of said pair of main switches; and opening said other diverter switch so that current is diverted to the first path associated with said other main switch.

11. The method of claim 10 in which said opening and closing of the diverter switches is synchronised to load current zeros.

12. A tap changer comprising: a high voltage transformer winding having a high voltage terminal; a plurality of tap breakers each connected between respective taps in said winding and alternate first electrical paths which share a common portion; a second terminal; and a changeover switch comprising a pair of first main switches each respectively connected in said first electrical paths between said tap changers and said second terminal; a second electrical path also sharing a common portion; a pair of diverter switches for diverting current in said respective first paths along respective second paths during changeover; and an auxiliary circuit, including an auxiliary transformer, an auxiliary switch and a varistor; said auxiliary transformer having primary and secondary windings, the primary winding of said transformer being connected in said common portion of said first paths; and said auxiliary switch and said varistor both being connected in parallel across the secondary winding of said auxiliary transformer.

13. The tap changer of claim 12 in which said second paths include a snubbing inductance connected, at one end, commonly to said diverter switches and, at the other end, to said second terminal.

* * * * *